US011187486B2

(12) United States Patent
Bauer et al.

(10) Patent No.: US 11,187,486 B2
(45) Date of Patent: Nov. 30, 2021

(54) RECOIL BUFFER FOR MACHINE GUN MOUNT

(71) Applicant: Design West Technologies, Inc., Tustin, CA (US)

(72) Inventors: Maria E. Bauer, Irvine, CA (US); Sam de la Torre, Riverside, CA (US); Ryan Hur, Irvine, CA (US)

(73) Assignee: Design West Technologies, Inc., Tustin, CA (US)

( * ) Notice: Subject to any disclaimer, the term of this patent is extended or adjusted under 35 U.S.C. 154(b) by 0 days.

(21) Appl. No.: 16/795,122

(22) Filed: Feb. 19, 2020

(65) Prior Publication Data

US 2020/0263949 A1 Aug. 20, 2020

Related U.S. Application Data

(60) Provisional application No. 62/807,678, filed on Feb. 19, 2019.

(51) Int. Cl.
*F41A 25/18* (2006.01)
*F41A 25/02* (2006.01)
*F41A 25/12* (2006.01)

(52) U.S. Cl.
CPC ..... *F41A 25/18* (2013.01); *F41A 25/02* (2013.01); *F41A 25/12* (2013.01)

(58) Field of Classification Search
CPC ..... F41A 25/02; F41A 25/04; F41A 25/16; F41A 25/18; F41A 25/20; F16F 5/00; F16F 9/3405; F16F 9/00–585; F16F 13/00–305
See application file for complete search history.

(56) References Cited

U.S. PATENT DOCUMENTS 446,426 A * 2/1891 Bryon, Jr. ..... F16F 9/3405 188/317
2,748,898 A * 6/1956 Bourcier ..... F16F 9/348 188/317
4,150,819 A * 4/1979 Taylor ..... F41A 25/02 188/268
4,867,043 A * 9/1989 Antkowiak ..... F16F 9/363 92/165 R
5,273,494 A * 12/1993 Varin ..... F16H 7/0848 474/110
8,127,901 B1 * 3/2012 Lu ..... F16F 9/585 188/322.15
9,441,699 B2 * 9/2016 Lawler ..... F16F 9/3484
2002/0084158 A1 * 7/2002 Matsuhashi ..... F16F 9/512 188/297
2004/0222579 A1 * 11/2004 Adoline ..... F16F 9/0218 267/250

(Continued)

FOREIGN PATENT DOCUMENTS

DE 735887 C * 5/1943 ..... F41A 25/02
DE 3437653 A1 * 4/1986 ..... F41A 25/02
FR 1132801 A * 3/1957 ..... F41A 5/20

*Primary Examiner* — Gabriel J. Klein
(74) *Attorney, Agent, or Firm* — Inskeep IP Group, Inc.

(57) ABSTRACT

Recoil buffers are described that can complete a displacement cycle in about 0.06 seconds or less. The buffer can include two springs and three one-way valves through the piston within the buffer housing or can include a single spring and a one-way shim valve through the piston within the buffer housing.

13 Claims, 14 Drawing Sheets

(56) References Cited

U.S. PATENT DOCUMENTS

2008/0121834 A1* 5/2008 Kern ..... F16H 7/0836
251/331
2014/0325885 A1* 11/2014 Lim ..... F41A 25/10
42/1.06

* cited by examiner

RECOIL BUFFER FOR MACHINE GUN MOUNT

RELATED APPLICATIONS

This application claims priority to U.S. Provisional Application Ser. No. 62/807,678 filed Feb. 19, 2019 entitled Recoil Buffer, which is hereby incorporated herein by reference in its entirety.

BACKGROUND OF THE INVENTION

Heavy machine guns, automatic grenade launchers, and similar heavy weapons are typically mounted on gun mounts that are fixed to a pedestal. These gun mounts and pedestals help support the weight of the heavy weapon while also allowing it to be pivoted around at various angles to aim.

One popular, standardized gun mount is the MK93 which can be used with heavy machine guns (e.g., M2HB/M3 0.50 Cal) or automatic grenade launchers (e.g., MK19 MOD 3 40 mm Automatic Grenade Launcher). MK93 mounts are typically used in conjunction with a Universal Pintle Adapter, Traverse and Elevation Mechanism, and Bearing Sleeve, which attaches to the socket on the vehicle turret A-Frame or tripod. MK93 mounts can be seen in several different patent publications, such as U.S. Pat. Nos. 8,578,644; 7,770,505; 8,584,393; and US 2016/0216056, all of which are hereby incorporated by reference.

Some MK93 gun mounts include recoil buffers which help absorb and reduce the force of kickback or recoil from each shot fired from the gun. In this respect, the recoil buffers can significantly improve aim and control of the gun, and therefore shot grouping. Highly reproducible buffering and elimination of variation of the buffering performance is thought to reduce or limit negative recoil influences on the accuracy of the shots fired from the gun.

Therefore, a MK93 buffer that provided more reproducible buffering and reduced buffer variations would be valuable for improving the accuracy and shot grouping of machine guns.

SUMMARY OF THE INVENTION

The present invention is generally directed to a recoil buffer or piston that can be used in gun mounts such as the MK93 mount. In one embodiment, the recoil buffer can complete a displacement cycle (i.e., depressing the piston shaft and returning it to the original uncompressed position) in less than 0.1 second. In another embodiment, the recoil buffer can complete a displacement cycle in about 0.06 seconds.

In one embodiment, the recoil buffer includes an inner spring and an outer spring that are positioned against a piston within the recoil buffer housing. The piston also includes multiple ball valves (e.g., 3) that are configured to close off passages through the piston during the compression portion of the displacement cycle and to open during the decompression portion of the displacement cycle.

In another embodiment, the recoil buffer has a single spring positioned against a piston within the recoil buffer housing to as to bias the piston to a decompressed position. A shim valve closes off passages through the piston during the compression portion of the displacement cycle and opens up the passages during the decompression portion of the displacement cycle. The shim valve is formed by a plate member that axially slides on a post on the piston. Optionally, the piston may include several raised features that engage or mate with grooves in the plate member so as to ensure even movement of the plate during a displacement cycle. These features also help prevent the spring from interfering with the plate.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
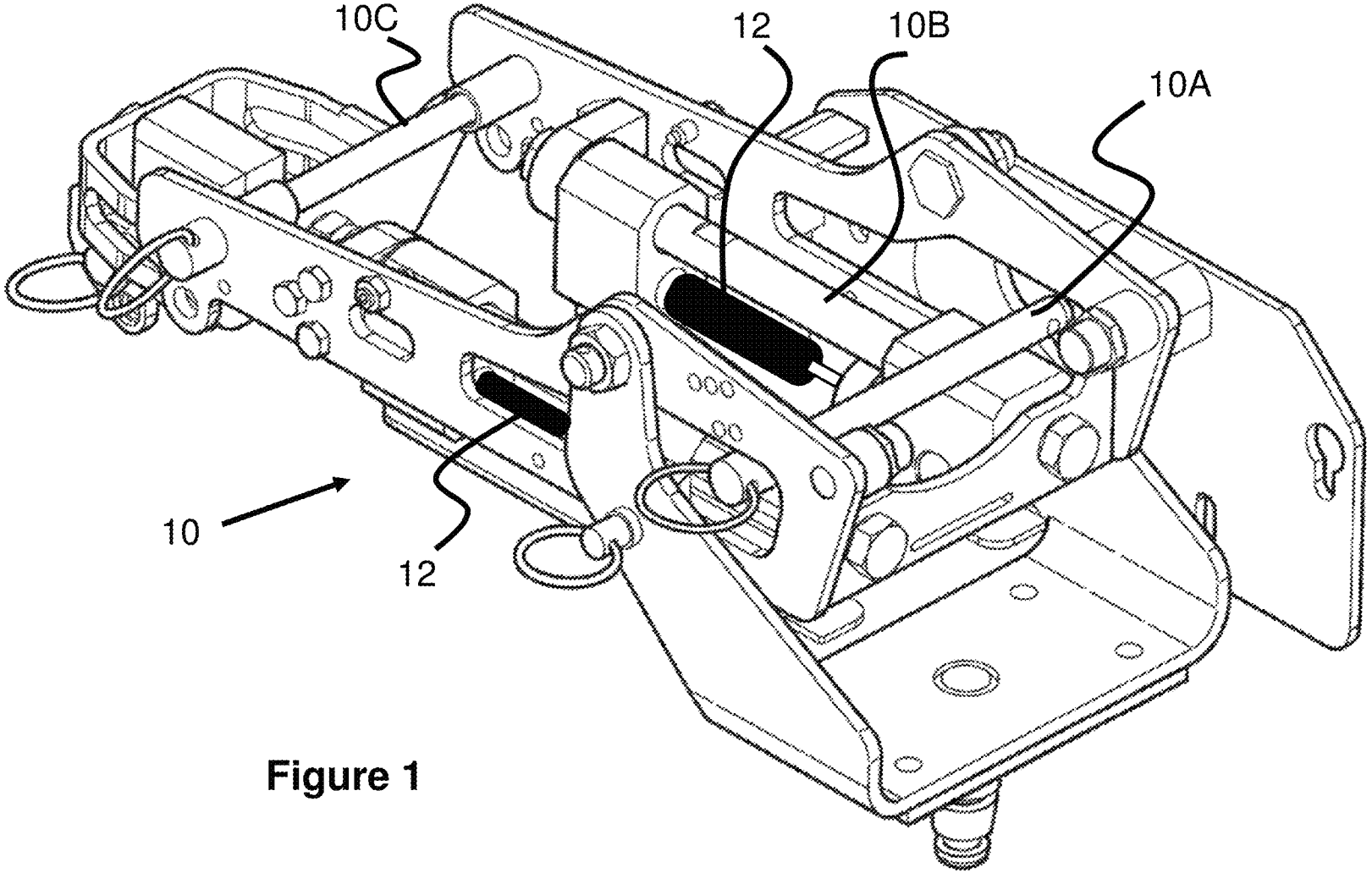
FIG. 1 is a perspective view of a MK93 gun mount according to the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. In that respect, elements and functionality of one embodiment not necessarily only limited to that embodiment and may be combined with other embodiments shown herein in any manner that would result in a functional embodiment. The terminology used in the detailed description of the embodiments illustrated in the accompanying drawings is not intended to be limiting of the invention. In the drawings, like numbers refer to like elements, including between different embodiments.

As discussed in greater detail below, one embodiment of the present invention is directed to a buffer or piston for an MK93 gun mount in which the piston shaft returns to an uncompressed position in a shorter time (e.g., 0.06 seconds or less) and with greater regularity than current prior art designs. The time the piston shaft completes its displacement cycle and returns to its uncompressed position is an important buffer characteristic. For a single shot, the return time may be of lesser importance, but when multiple shots are fired quickly, as a machine gun is capable of, the slow return time can result in increasing displacement of the piston shaft and possibly reduced firing rate until the buffer is no longer able to mitigate the recoil energy of the gun. In other words, if the buffer does not complete its displacement cycle quickly enough, each shot will start the displacement cycle at an increasingly compressed position until the piston shaft can no longer be compressed.

Figure 2:
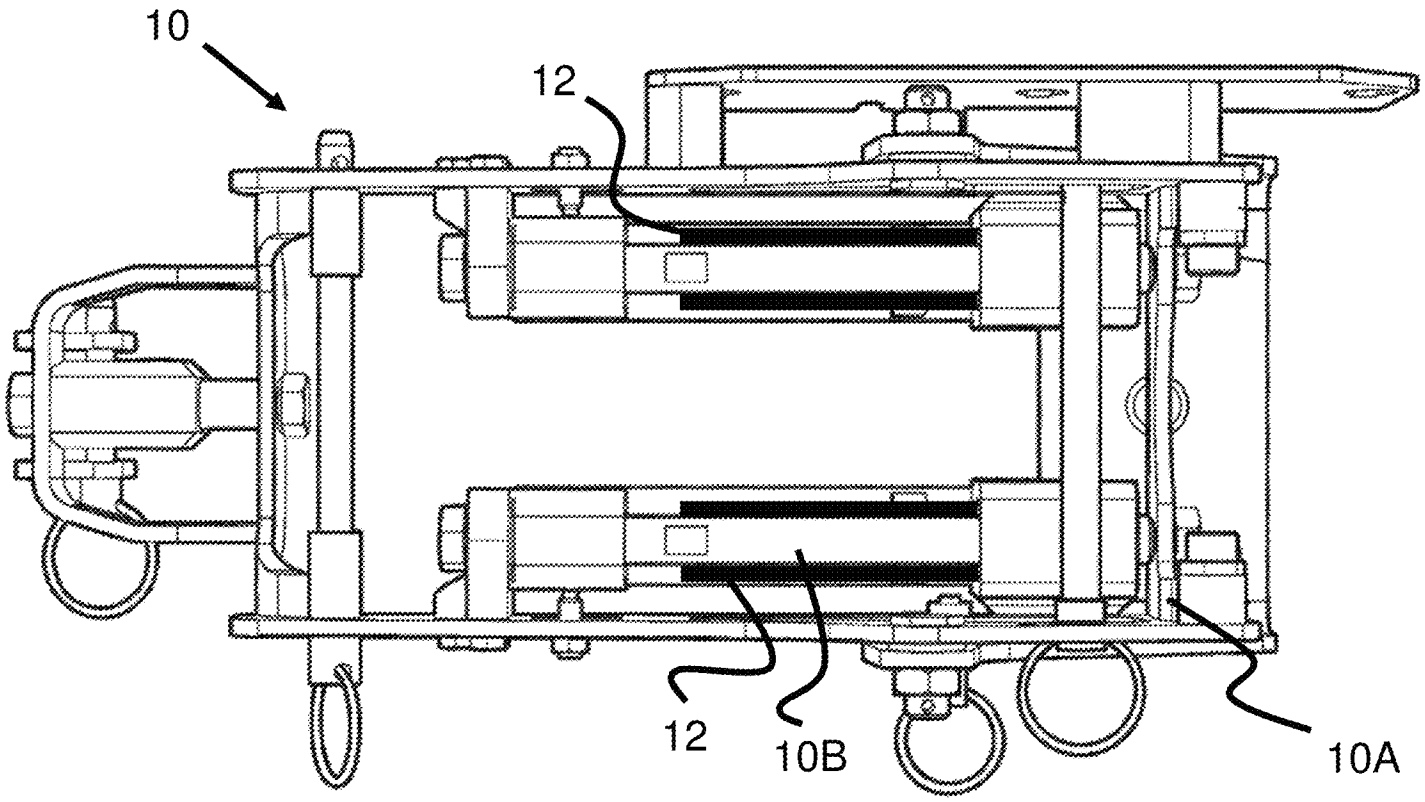
FIG. 2 is a top view of the MK93 gun mount of FIG. 1 according to the present invention.

FIGS. 1 and 2 illustrate an example MK93 gun mount 10 that can be used according to the present invention. A gun, such as a machine gun, can be mounted to a top portion of the mount 10 via mounting pins 10A and 10C. The mounting pins 10A and 10C can longitudinally slide along shafts 10B on each side of the mount 10. Beneath each of the shafts 10B are recoil buffers or hydraulic pistons 12 that a connected to the top portion 10A such that they compress to absorb the recoil force generated from an attached gun.

Figure 3:
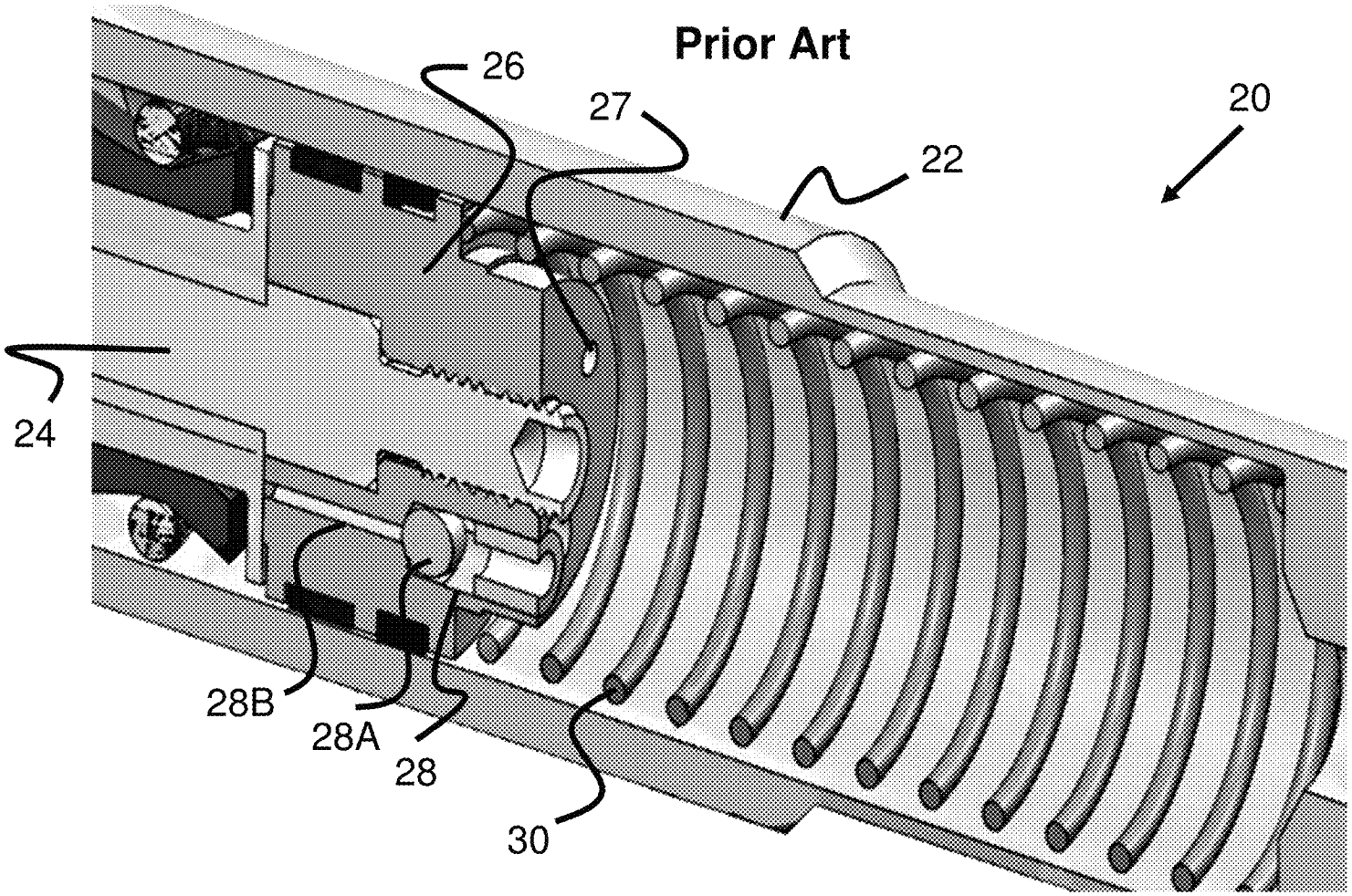
FIG. 3 is a prior art design of a recoil buffer.
Figure 4:
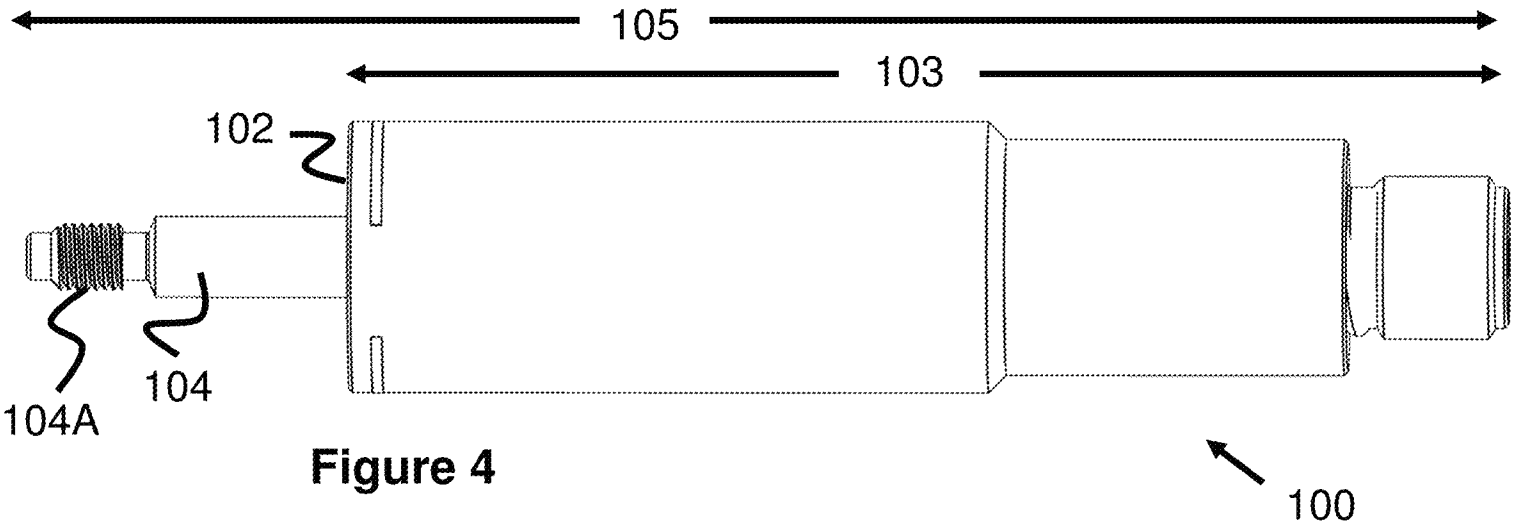
FIG. 4 is a side view of a recoil buffer according to the present invention.
Figure 5:
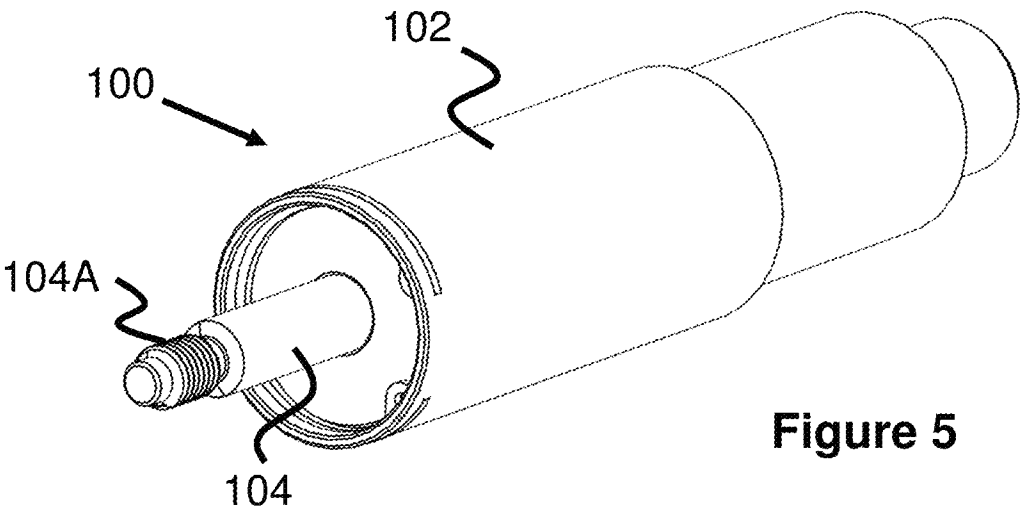
FIG. 5 is a perspective view of the recoil buffer of FIG. 4 according to the present invention.

FIG. 3 illustrates a prior art recoil buffer 12 having an outer housing 22 that contains a piston shaft 24 connected to a piston member 26. The piston member 26 includes a single piston compression intake valve 28 and a single compression chamber spring 30. As the piston shaft 24 and piston 26 are compressed inwards into the compression chamber (i.e., to the right of the figure), the ball member 28A of the valve moves to the left against the opening of passage 28B, closing off the valve 28 and therefore the compression chamber. This allows the hydraulic oil and the spring 30 to absorb the force of the recoil from the gun.

Once the piston shaft 24 has been displaced from the recoil force, the spring 30 pushes the piston 26 outward of the compression chamber (i.e., to the left of the figure). The ball member 28A then moves away from the passage 28B, opening up the valve 28 and allowing hydraulic oil out of the compression chamber. Additionally, the bleed passages 27 allow for the hydraulic oil to slowly flow through during compression.

FIGS. 4-10 illustrate various views of an embodiment of an improved recoil buffer 100 according to the present invention. Referring first to the external views of FIGS. 4 and 5, the buffer 100 has a housing 102 with a length 103 of about 5.34 inches, a total length 105 of about 6.85 inches including the piston shaft 104, and a diameter of about 1.25 inches at its largest portion. Preferably, the piston shaft 104 includes a threaded portion 104A for connection to the mount 10.

In operation, when the gun attached to the MK93 gun mount 10 is fired, the recoil force causes the piston shaft 104 to be quickly pushed into the housing 102. As discussed further below, the components within the buffer 100 then push the piston shaft 104 back out of the housing 102 to its starting position.

Figure 6:
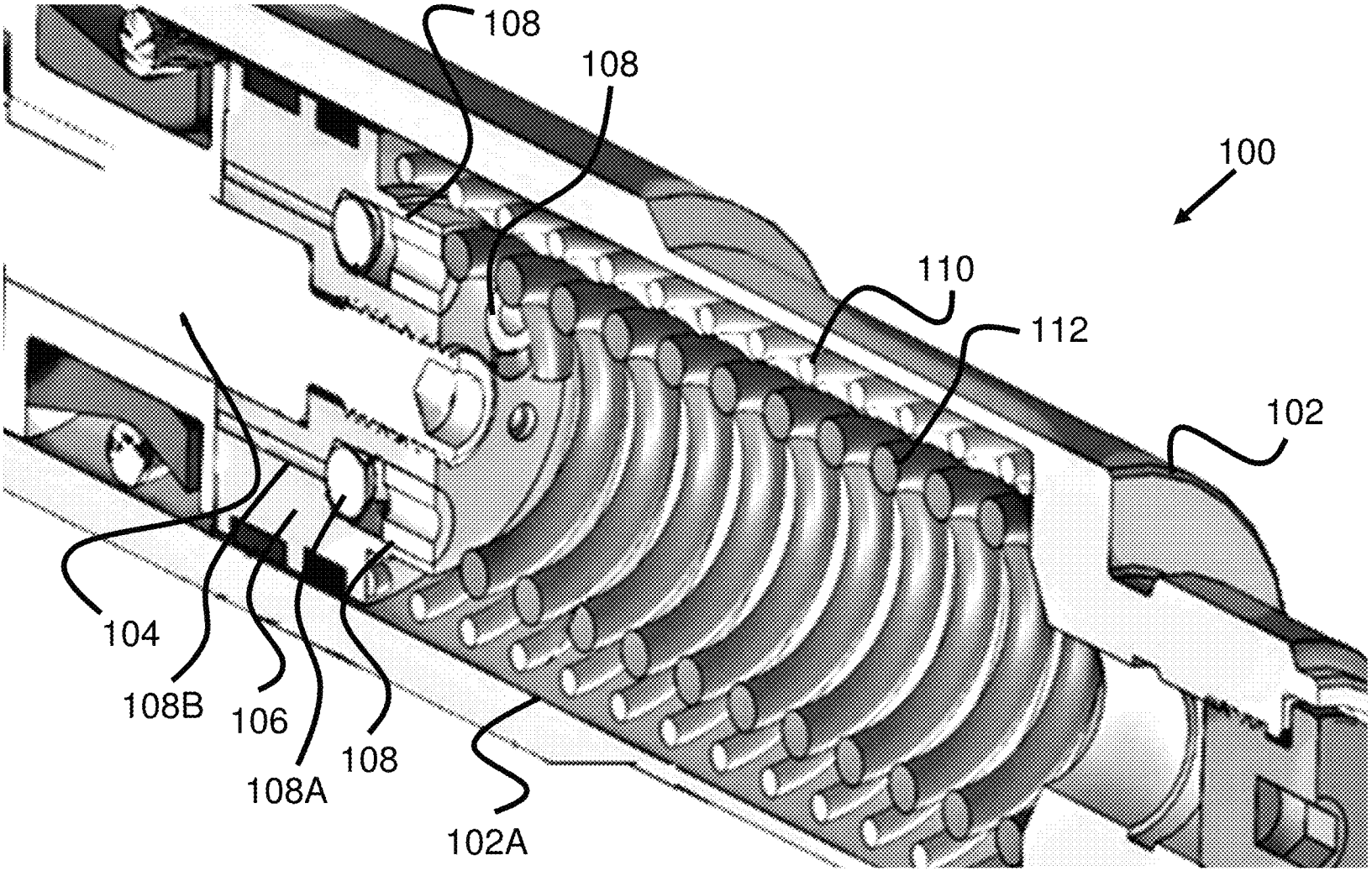
FIG. 6 is a cross sectional view of the recoil buffer of FIG. 4 according to the present invention.
Figure 7:
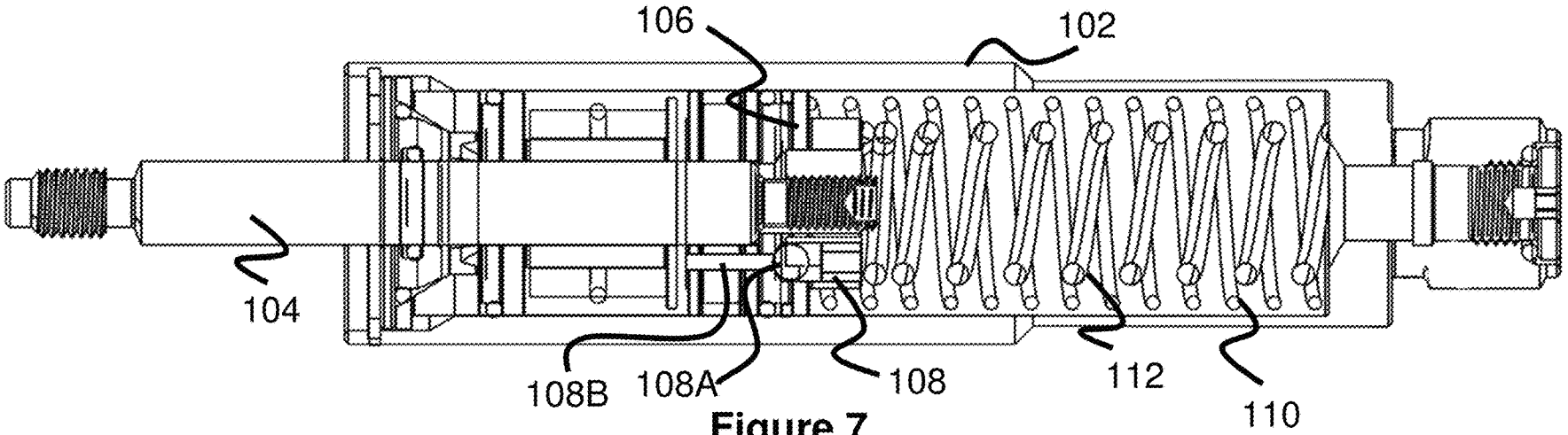
FIG. 7 is a cross sectional view of the recoil buffer of FIG. 4 according to the present invention.
Figure 8:
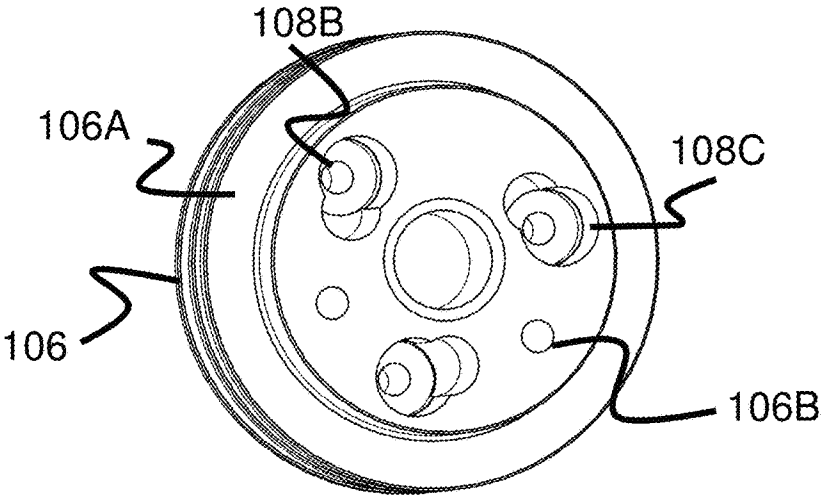
FIG. 8 is a view of a piston from the recoil buffer of FIG. 4 according to the present invention.
Figure 9:
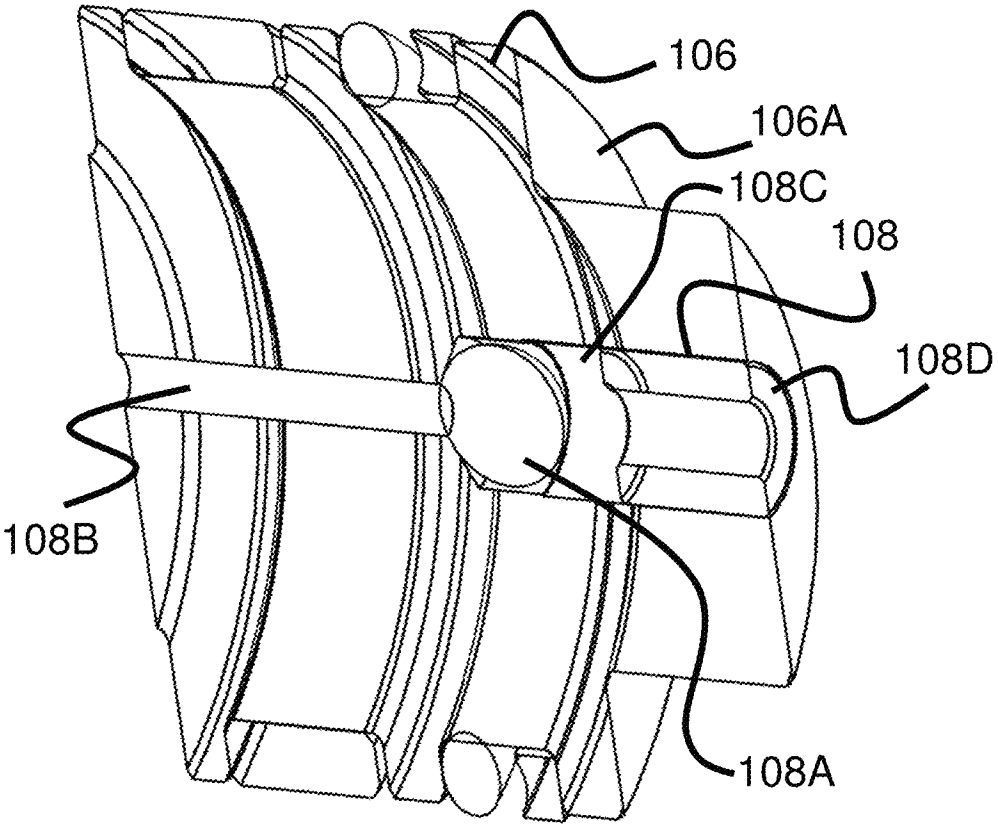
FIG. 9 is a magnified view of a valve from the recoil buffer of FIG. 4 according to the present invention.
Figure 10:
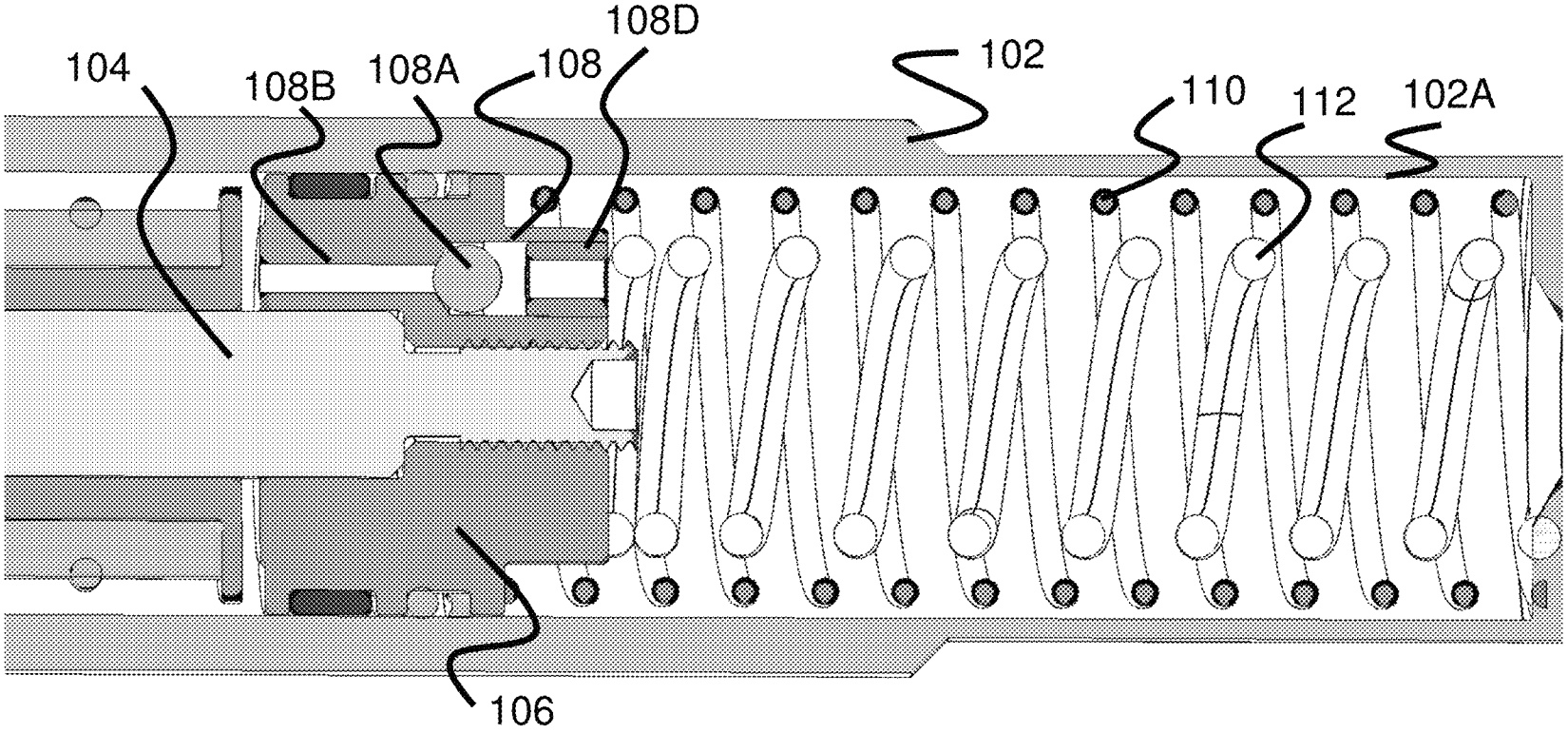
FIG. 10 is a cross sectional view of the recoil buffer of FIG. 4 according to the present invention.
Figure 11:
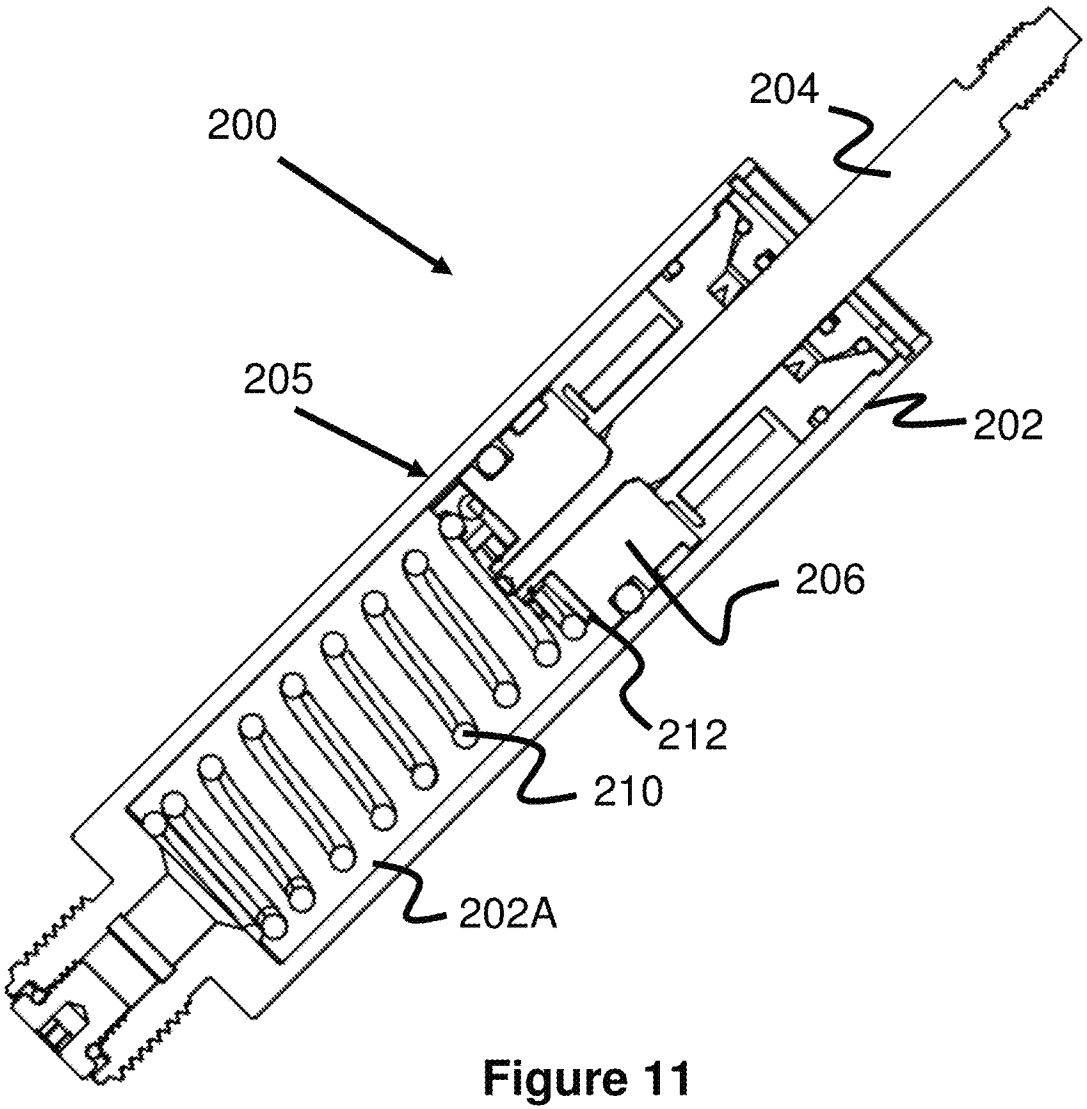
FIG. 11 is a cross sectional view of another embodiment of a recoil buffer according to the present invention.
Figure 12:
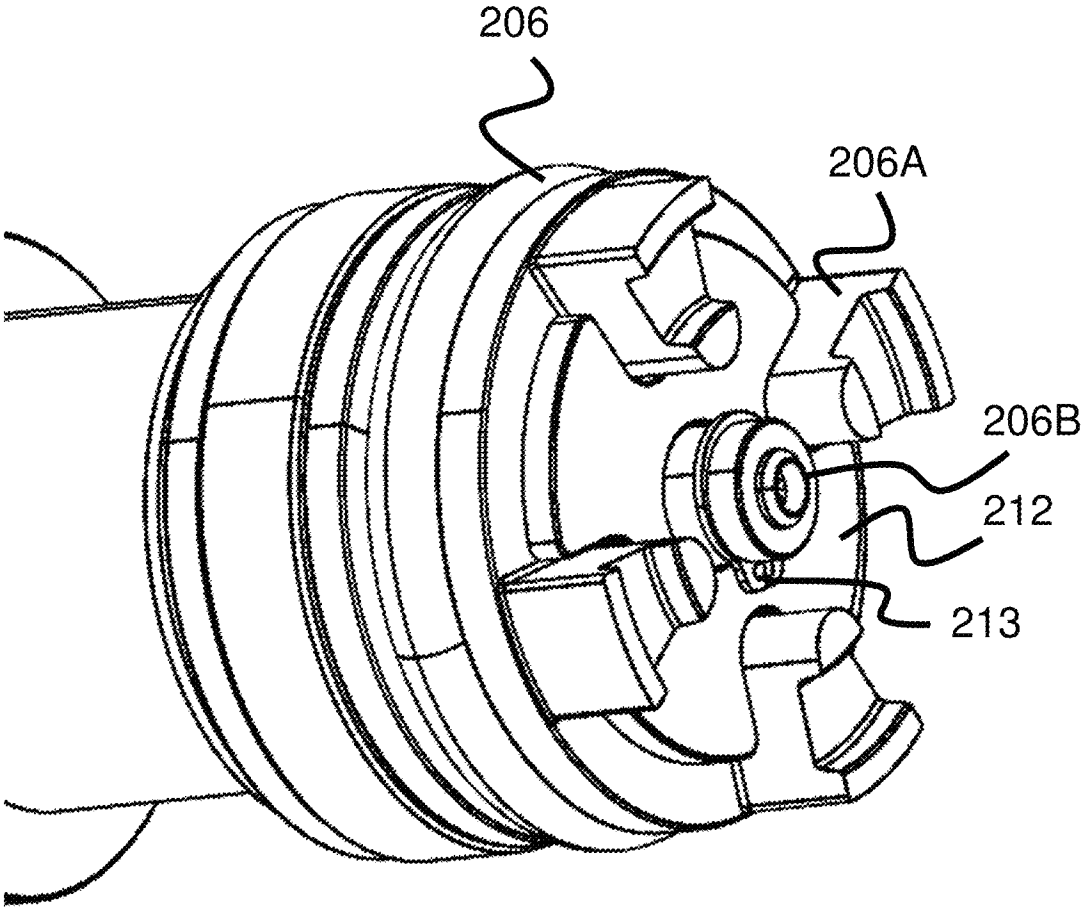
FIG. 12 is a perspective view of a piston of the recoil buffer of FIG. 11 according to the present invention.

FIGS. 6 and 7 illustrate two views within the housing 102 of one embodiment of the recoil buffer 100. The buffer 100 generally differs from the prior art in that it includes 1) both an inner spring 112 and an outer spring 110, and 2) and includes three ball valves 108 extending through the piston 106, both of which help return the piston 106 back to its initial uncompressed position in a relatively quick and regular manner.

Turning first to the outer spring 110, in one embodiment this spring 110 is disposed on a ledge 106A of the piston 106 (see FIG. 8) and an end surface of the compression passage 102A opposite the piston 106. In one embodiment, the outer spring is about 3.4 inches in length when uncompressed and has an outer diameter of about 0.981 inches. The wire of the spring 110 has a diameter of about 0.105 inches, has about 11.75 total coils, 9.75 active coils, and a spring rate of 24.16 lb/inch.

The inner spring 112, is disposed against the inner raised surface of the piston 106 (see FIG. 8) and an end surface of the compression passage 102A opposite the piston 106. In one embodiment, the inner spring 112 is about 18.29 mm in outer diameter, 69.85 mm in length, is composed of 2.44 mm diameter wire (0.096 inch), and has a spring rate of 52.1 lb/inch.

The three ball valves are located at equal distances from each other in the radial dimension. As seen best in FIGS. 8 and 9, the piston 106 includes a larger area 108C in which the ball 108A is located. A tubular retaining member 108D maintains the ball 108A within the area 108C and has an inner diameter of about 0.09 inch. When the piston 106 is pushed inwards (i.e., to the right) the ball 108A covers passage 1088 through the piston 106, preventing hydraulic fluid from passing through the valve. In this respect, hydraulic fluid may only pass through passages 1068. Once the piston 106 has absorbed the recoil force of the gun, the piston 106 begins moving back to its uncompressed position (i.e., to the left). The balls 108A move to the right, opening up passages 1088 to allow hydraulic fluid to pass through. Hence, the piston 106 can quickly return to its starting position. In one embodiment, the passage 108B has a diameter of 0.09 inch, the larger area 108C has a diameter of about 0.17 inch, and the ball has a diameter of about 0.155 inch.

FIGS. 11-14 illustrates various views of another embodiment of a buffer 200 according to the present invention. The buffer 200 has an outer housing 202 of similar dimensions to housing 102 and includes an inner compression chamber 202A. Unlike the prior embodiment 100, the buffer 200 includes only a single spring 210 and a shim valve 205.

Turning first to the spring 210, it preferably has an outer diameter of about 0.875 inch, a wire diameter of about 0.120 inch, an uncompressed length of about 2.25 inches, and a spring rate of about 78.65 lb/inch. The spring 210 preferably contacts a side surface of the piston 206 and a side of the compression chamber 202A opposite the piston 206.

The shim valve 205 is composed of a plate 212 (see best in FIGS. 12 and 13) that has a center aperture 212A that is positioned around the center post 206B of the piston 206. The plate 212 slides along the axis of the post 206B between a position contacting the side surface of the piston 206 and a position spaced apart from the side surface of the piston 206. A retaining ring 213 is connected near an end of the post 206B and has a larger diameter than the post 206B, preventing the plate 212 from moving off of the post 206B. In one embodiment, the plate 212 can slide about 1.6 inches.

Figure 13:
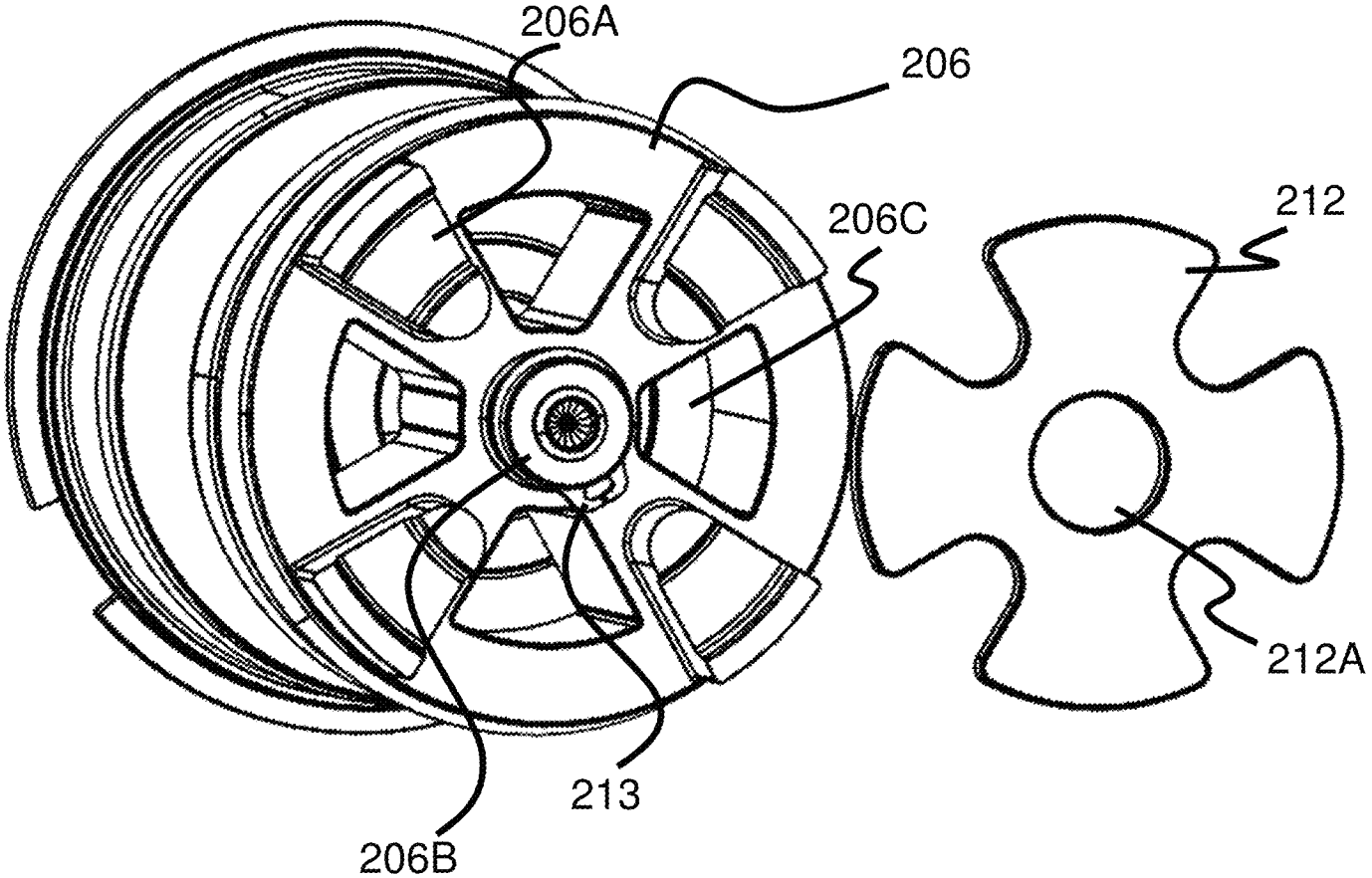
FIG. 13 is a perspective view of a piston of the recoil buffer of FIG. 11 according to the present invention.
Figure 14:
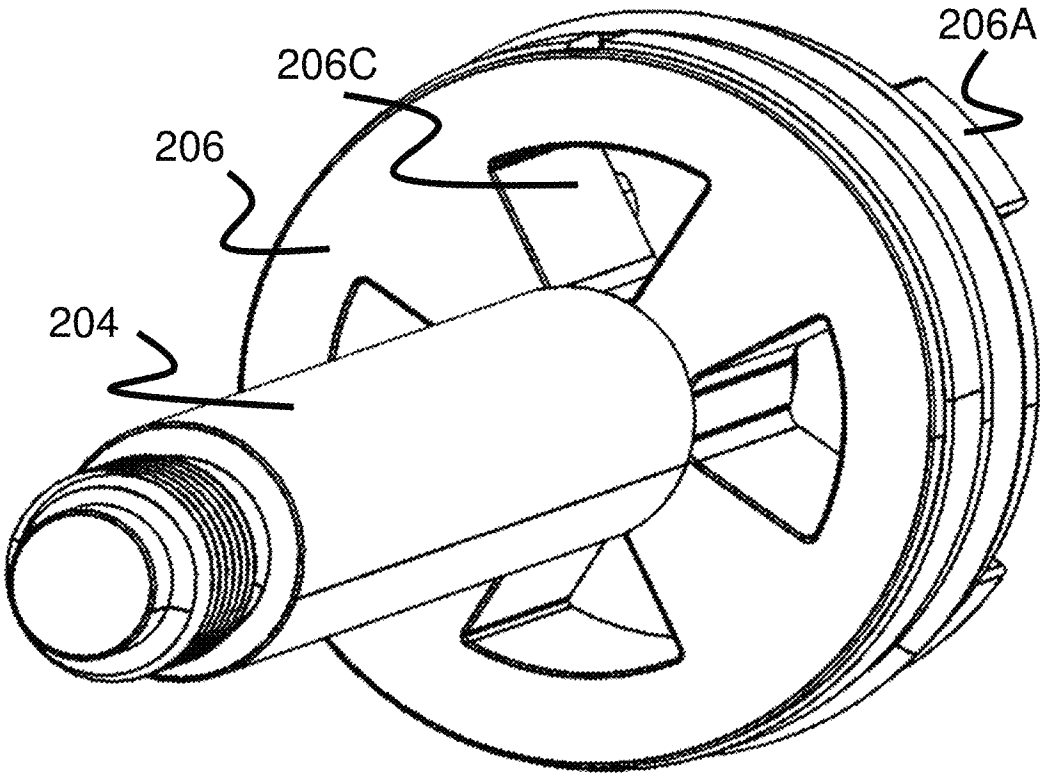
FIG. 14 is a perspective view of a piston of the recoil buffer of FIG. 11 according to the present invention.

As seen best in FIGS. 13 and 14, the piston 206 has a plurality of relatively large passages 206C extending through its body. In one embodiment, the passage 206C has a front and back surface of 0.155 and 0.380 inches from the center of the piston 206 and has sides angled at about 60 degrees. When the plate 212 is positioned in contact with the surface of these passage 206C, such as during the initial compression of the piston shaft 204 and piston 206, the plate 212 closes the passages 206C. When the piston 206 decompresses (i.e., moves to the left), the plate 212 moves away from the passages 206C, thereby allowing the hydraulic fluid to pass through the piston relatively quickly. In one embodiment, the piston 206 includes 4 passages that each have a size of about 0.17 inch The plate 212 can take the form of a variety of shapes, such as a circular or square shaped plate. In the present embodiment, the plate 212 has a cross shape with large grooves that are shaped to mate with raised structures 206A on the piston 206A. The raised structures 206A help ensure that the plate 212 moves evenly relative to the piston 206. In one example, the plate 212 has a diameter of about 0.810 inches, an inner aperture diameter of about 0.229 inches, and a diameter between the grooves of about 0.430 inches.

The embodiments of this application may use a hydraulic fluid with a viscosity of preferably 50 cs that demonstrates both high and low temperature stability. For example, Dow Corning 510 phenylmethyl polysiloxane may be used.

The housing of the embodiments of the present invention can be composed of steel or anodized aluminum. The anodized aluminum may be preferable because this material provides better temperature dissipation which can otherwise destroy seals and lead to irregular buffer behavior.

Test Results

The current landscape of recoil buffers for heavy machine guns was found to be made up of products by companies such as Enidine, Taylor, Kynshot, and Ringfeder. The respective buffers were obtained and tested for a purpose built MK93 Recoil Simulator which used a motor and rotating wheel to move a mass of about 42 lbs against a tested buffer. The time to return of the shaft to uncompressed position and maximum displacement were measured on the different buffers, as well as the temperature to determine the developed heat during dynamic cycling.

Several of the buffers did not return within a desired amount of time (more than 0.1s based on a maximum firing rate of 600 rpm), thus leading to increasing displacement throughout dynamic testing at 550 rpm until the maximum displacement of about 1 in (defined by the spring reaching solid state, thus maximum displacement of the shaft and piston) is reached and the buffer no longer mitigates recoil energy.

Figure 15:
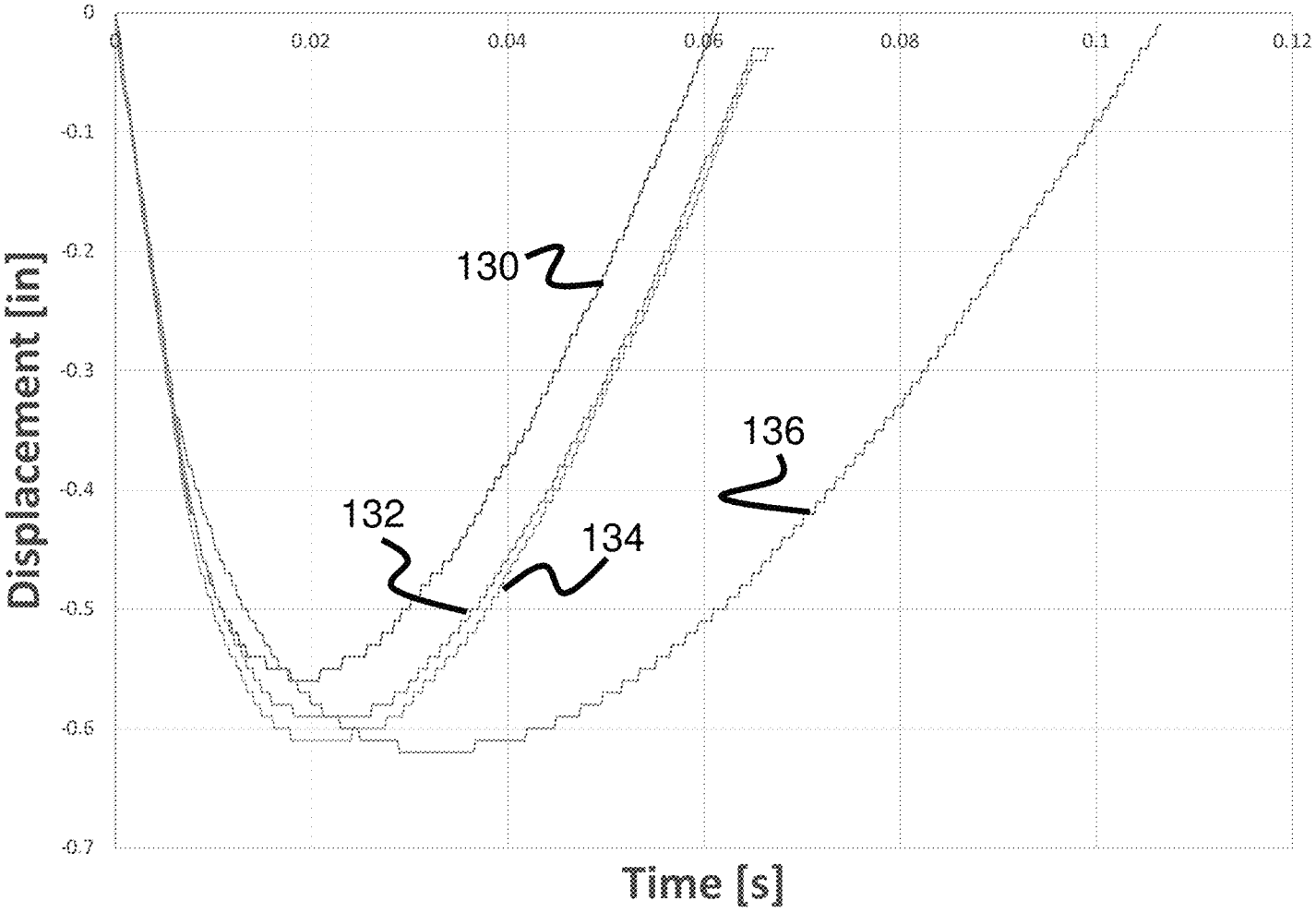
FIG. 15 is a graph comparing the displacement cycle of the recoil buffers of the present invention with a prior art recoil buffer.

FIG. 15 illustrates time-displacement graphs for dynamic testing of either of the buffers 100 or 200 over 10 rounds 130, 5,000 rounds 132, and 10,000 rounds 134. For comparison one of the competitor's buffer data 136 was taken from a single shot event because this buffer is not able to maintain reproducible time-displacement motion at an impact rate of 550 rpm. As can be seen, buffer 100/200 performance is relatively constant over different test durations and therefore is expected to produce better shot groupings.

Figure 16:
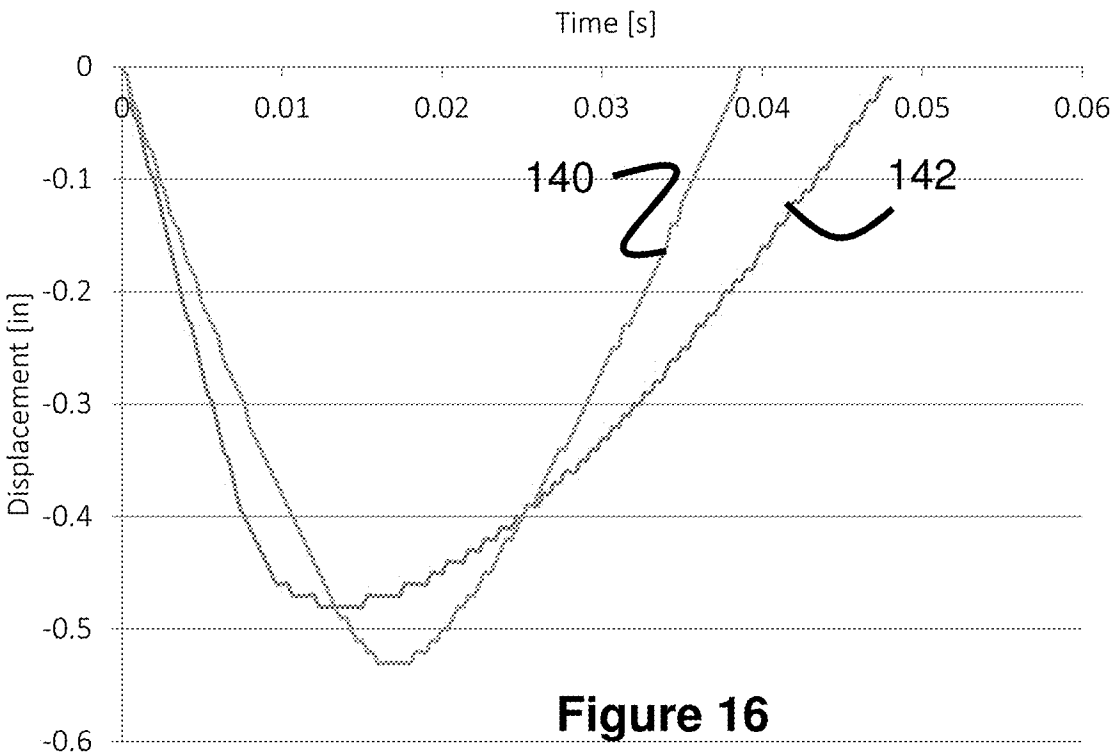
FIG. 16 illustrates a time displacement graph of the first embodiment of the recoil buffer and the second embodiment of the recoil buffer.

FIG. 16 illustrates a time displacement graph of the first embodiment 100 and the second embodiment 200. As seen, the second embodiment 200 may have a displacement cycle time 140 of less than 0.04 seconds while the first embodiment 100 may have a displacement cycle time 142 of less than 0.05. As can be seen, the buffer 200 forms a more symmetric time vs. displacement curve which can result in better firing performance.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A buffer for a gun mount, comprising:
- a buffer housing having an internal chamber;
- a piston shaft configured to move into and out of the housing;
- a piston having a first end fixed on a first end of the piston shaft;
- one or more passages extending between the first end and a second end of the piston;
- a plurality of raised structures extending from the second end of the piston;
- a plate disposed on the second end of the piston and having a plurality of grooves that each mate with one of the plurality of raised structures to allow even movement of the plate relative to the piston, the plate configured to open and close the one or more passages; and,
- a spring positioned against the plurality of raised structures on the second end of the piston, in front of the plate, and against a side of the internal chamber of the buffer housing such that the plate is movable between the piston and the spring.

2. The buffer of claim 1, wherein the plate has a cross shape.

3. The buffer of claim 1, wherein the spring rate is 78.65 lb/inch.

4. The buffer of claim 1, wherein the plate slides along a post on the piston.

5. The buffer of claim 1, wherein the passages have a dimension of 0.155 and 0.380 inches from a center of the piston, and wherein the sides of the passages are at 60 degrees relative to each other.

6. The buffer of claim 1, wherein the plate has an outer diameter of 0.810 inches.

7. A buffer for a gun mount, comprising:
- a buffer housing having an internal chamber;
- a piston shaft configured to move into and out of the housing;
- a piston having a first end fixed on a first end of the piston shaft;
- one or more passages extending between the first end and a second end of the piston;
- a plurality of raised structures located on the second end of the piston;
- a plate disposed on the second end of the piston and having a plurality of cut-away areas that each are each positioned at least partially around one of the plurality of raised structures to facilitate even movement of the plate relative to the piston, the plate configured to open and close the one or more passages; and,
- a spring positioned against the plurality of raised structures on the second end of the piston, in front of the plate, and against a side of the internal chamber of the buffer housing such that the plate is movable between the piston and the spring.

8. The buffer of claim 7, wherein the plate has a cross shape.

9. The buffer of claim 7, wherein each of the plurality of raised structures have a triangular shape.

10. The buffer of claim 7, wherein the one or more passages each have sides that are at 60 degrees relative to each other.

11. The buffer of claim 7, wherein the spring rate is 78 lb/inch.

12. A buffer for a gun mount, comprising:
- a buffer housing having an internal chamber;
- a piston shaft configured to move into and out of the housing;

a piston having a first end fixed on a first end of the piston shaft;

at least one passage extending between the first end and a second end of the piston;

a plurality of raised structures located on the second end of the piston;

a plate disposed on the second end of the piston and having a plurality of circumferentially located cut-away areas that each are each positioned at least partially around one of the plurality of raised structures to facilitate even movement of the plate relative to the piston, the plate being configured open or close the at least one passage; and, a spring positioned against the plurality of raised structures on the second end of the piston, in front of the plate, and against a side of the internal chamber of the buffer housing such that the plate is movable between the piston and the spring.

13. A buffer for a gun mount of claim 12, wherein the spring is positioned against a groove on each of the plurality of raised structures.

* * * * *